US006531103B1

(12) United States Patent
Hakka et al.

(10) Patent No.: US 6,531,103 B1
(45) Date of Patent: Mar. 11, 2003

(54) PROCESS FOR REMOVING SULFUR COMPOUNDS FROM GAS AND LIQUID HYDROCARBON STREAMS

(75) Inventors: Leo Ernest Hakka, Dollard des Ormeaux (CA); Paulino Forte, Yonkers, NY (US)

(73) Assignee: Union Carbide Chemicals and Plastics Technology Corporation, Danbury, CT (US)

( * ) Notice: Subject to any disclaimer, the term of this patent is extended or adjusted under 35 U.S.C. 154(b) by 0 days.

(21) Appl. No.: 09/521,654

(22) Filed: Mar. 9, 2000

(51) Int. Cl.[7] ..... C07C 7/00

(52) U.S. Cl. ..... 423/242.2; 423/242.6; 423/226; 48/127.3; 208/208 R; 208/237; 208/238; 208/244; 208/289; 208/290; 208/295; 585/850; 585/856; 585/860; 585/864; 585/865; 585/867

(58) Field of Search ..... 95/235; 585/850, 585/856, 860, 864, 865, 867; 208/208 R, 237, 238, 244, 289, 290, 295; 48/127.3; 423/242.2, 242.6, 226

(56) References Cited

U.S. PATENT DOCUMENTS

| | | | | |
|---|---|---|---|---|
| 3,034,865 | A | 5/1962 | Urban | 23/225 |
| 3,108,081 | A | 10/1963 | Gleim et al. | 252/428 |
| 3,154,483 | A | 10/1964 | Urban | 208/206 |

(List continued on next page.)

FOREIGN PATENT DOCUMENTS

| | | | | |
|---|---|---|---|---|
| JP | 49-117504 | * 11/1974 | | 208/237 |

OTHER PUBLICATIONS

International Search Report dated Sep. 13, 2001 issued by the EPO acting as the International Searching Authority in PCT/US01/07518.

Article: Photochemisty and Photobiology, vol. 47, No. 5, pp. 713–717—1988—"Biological Activities of Phthalocyanines–Syntheses and Analyses of Sulfonated Phythalocyanines"—Langlois, Wagner, Brasseur, Paquette and van Lier.

Article: Inorg. Nucl. Chem. Letters, vol. 7, pp. 161–169—1971—"the Dimerization Polymerization, and Hydrolysis of $Fe^{III}$–4,4', 4", 4"–Tetrasulfoophthalocyanine"—Sigel, Waldmeier, and Prijs.

Article: Kirk–Othmer Encyclopedia of Chemical Technology—3rd Edition, vol. 17, pp. 777–787—1982—"Phthalocyanine Compounds"—Bemis, Dindorf, Horwood and Samans.

(List continued on next page.)

*Primary Examiner*—Stanley S. Silverman
*Assistant Examiner*—Timothy C. Vanoy

(57) ABSTRACT

The present invention provides a process for removing sulfur compounds including sulfur in the (−2) oxidation state such as mercaptans, dialkyl sulfides, carbonyl sulfide, hydrogen sulfide, thiophenes and benzothiophenes, from liquid or gas feed streams, particularly hydrocarbon feed streams such as, for example, natural gas and refinery process streams. According to the process, such a feed stream including these sulfur impurities is contacted with an absorbent which includes a metal ion-containing organic composition such as, for example, iron, copper, lead, nickel, tin, zinc or mercury cation-containing phthalocyanine or porphyrin to thereby form sulfur-metal cation coordination complexes in which the oxidation state of the sulfur and the metal cation remains essentially unchanged. The complexes are separated from the feed stream, and the absorbent is regenerated by disassociating the sulfur compound from the complexes.

17 Claims, 3 Drawing Sheets

U.S. PATENT DOCUMENTS

| | | | | |
|---|---|---|---|---|
| 3,449,239 | A | 6/1969 | Moore | 208/198 |
| 3,525,683 | A | 8/1970 | Johnston et al. | 208/199 |
| 4,136,123 | A | 1/1979 | Hutchings | 568/563 |
| 4,336,233 | A | 6/1982 | Appl et al. | 423/228 |
| 4,537,753 | A | 8/1985 | Wagner et al. | 423/228 |
| 4,553,984 | A | 11/1985 | Volkamer et al. | 55/46 |
| 4,997,630 | A | 3/1991 | Wagner et al. | 423/228 |
| 5,093,094 | A | 3/1992 | Van Kleeck et al. | 423/224 |
| 5,149,880 | A | 9/1992 | Sawyer et al. | 568/324 |
| 5,582,714 | A | 12/1996 | Forte | 208/237 |
| 5,689,033 | A | 11/1997 | Forte et al. | 585/833 |

OTHER PUBLICATIONS

Article: CRC Press, Inc., vol. II—Manufacture and Applications, pp. 53–55—1983—"The Phthalocyanines"—Frank H. Moser ISBN 0–8493–5678–4 (v.2).

Article: Journal of Catalysts 29, pp. 513–516—1973—"The Influence of Sulphur Compounds on β–Cu–Phthalocyanine Used as an Oxidation Catalysts"—Friedrich Steinbach and Herbert Schmidt.

* cited by examiner

Iron PhthalocyanineDisodium Sulfonate Forming a Complex with the Sulfur in a Mercaptan Molecule.

A mercaptan molecule Complexing with Iron Porphine.

PROCESS FOR REMOVING SULFUR COMPOUNDS FROM GAS AND LIQUID HYDROCARBON STREAMS

BRIEF DESCRIPTION OF THE INVENTION

The present invention is directed to a process effective in removing sulfur compounds from gas or liquid feed streams, in particular, hydrocarbon streams such as natural gas and refinery process streams, nitrogen gas streams and other feed streams. More particularly, the present invention is directed to a process which utilizes a regenerable absorbent for removing sulfur compounds which include sulfur in the negative two (−2) oxidation state from feed streams containing these sulfur impurities.

BACKGROUND OF THE INVENTION

Hydrocarbon streams, such as natural gas and refinery process streams, contain a wide range of impurities which are removed for any of a variety of reasons, such as for health and/or environmental safety, and/or for process operability or reliability. Among the impurities present in these streams are sulfur compounds, in particular, reduced sulfur compounds, such as hydrogen sulfide ($H_2S$), mercaptans (designated generally as R—SH compounds), dialkyl sulfides (designated generally as $R_1$—S—$R_2$ compounds), carbonyl sulfide (COS), carbon disulfide ($CS_2$) and thiophenes. All of these compounds include sulfur in an oxidation state of (−2). Other impurities typically contained in these streams and removed for one or more of the above mentioned reasons include $H_2O$, $N_2$, and $CO_2$.

Several processes are known for removing sulfur containing impurities from hydrocarbon streams. These processes are commonly referred to as processes for sweetening sour hydrocarbon streams.

U.S. Pat. No. 3,449,239 discloses a process in which a sour hydrocarbon stream is contacted with a sweetening reagent, air and a diazine, such as piperazine. Suitable sweetening reagents are disclosed as including aqueous caustic solution and methanol, coupled with a metal phthalocyanine catalyst (for example, cobalt phthalocyanine or cobalt phthalocyanine disulfonate). According to the disclosure, the sweetening reaction comprises converting mercaptan to dialkyl disulfide through an oxidation reaction, and then removing disulfide from the stream. It is to be noted that dialkyl sulfides cannot be converted to dialkyl disulfides and thus may not be removed efficiently by this process.

U.S. Pat. No. 4,336,233 discloses processes for washing natural gases, coke-oven gases, gases from the gasification of coal and synthesis gases with aqueous solutions containing a specific amount of piperazine, or with a specific amount of piperazine in a physical or chemical solvent. The use of a specific concentration of piperazine is reported for the purpose of removing sulfur impurities such as $H_2S$, $CO_2$ and COS. Among the physical solvents disclosed are mixtures of dialkyl ethers of polyethylene glycols (e.g., SELEXOL solvent available from Union Carbide Corporation, Danbury, Conn.). The preferred chemical solvent is monoalkanolamine. According to the description in the '233 patent, COS can only be partially removed by the process. In order to achieve more complete removal, COS must first be converted by hydrogenation into more readily removable compounds ($CO_2$ and $H_2S$). These sulfur compounds are then removed by solvent absorption.

U.S. Pat. Nos. 4,553,984, 4,537,753, and 4,997,630 also disclose processes for removing $CO_2$ and $H_2S$ from gases.

Each patent discloses removing $CO_2$ and $H_2S$ by treating the gas with an aqueous absorption liquid containing methyldiethylanolamine. The absorbed $H_2S$ and $CO_2$ is then removed from the absorbent in one or more flashing stages and/or a steam stripping tower.

As mentioned above, liquid streams containing sulfur impurities are also subjected to treatment in an effort to reduce or eliminate sulfur impurities. One such process is disclosed in U.S. Pat. No. 5,582,714. The '714 patent discloses a process for reducing the sulfur content in petroleum fractions such as FCC (fluid catalytically cracked) gasoline by employing, for example, polyalkylene glycol and/or polyalkylene glycol ethers having a molecular weight of less than 400. The process requires the steps of treating the hydrocarbon stream with the solvent to produce a sulfur depleted hydrocarbon phase and a sulfur rich solvent phase, stripping the sulfur containing impurities from the solvent, separating the stripped sulfur containing stream into a sulfur rich component and an aqueous phase, washing the sulfur depleted hydrocarbon phase with the aqueous phase to remove any solvent from the sulfur depleted hydrocarbon phase, and then returning the washed solvent to the treating step.

Like the '714 patent, U.S. Pat. No. 5,689,033 is directed to processes for reducing impurities in liquid hydrocarbon feedstocks. More specifically, the process disclosed in the '033 patent involves removing sulfur compounds, oxygenates and/or olefins from C4–C6 fractions using lean solvents such as diethylene and/or triethylene glycol, certain butane glycols, and/or water or mixtures of these solvents. Thereafter, the removed compounds are stripped from the impurities-rich solvent stream.

These prior art processes reduce the content of sulfur containing compounds in hydrocarbon feed streams to some extent; however, each process exhibits significant shortcomings. Solvents such as aqueous alkanolamines or caustic, which work on the basis of a Bronsted acid/base reaction, are unable to remove dialkyl sulfides efficiently and are unable to slip $CO_2$, which in some cases is very desirable. Some, like the processes disclosed in the '239 patent and the '233 patent require a chemical reaction to convert sulfur containing impurities such as mercaptan and COS to other sulfur containing compounds which are more amenable to removal by solvent extraction. Other prior art processes employ a variety of solvents to solubilize the sulfur containing compounds, followed by elaborate chemical and water washing and stripping processes. These latter processes are not particularly effective in removing sulfur compounds, and also suffer from the drawback of removing valuable hydrocarbon fractions from the stream. Moreover, in some instances, these processes can be unstable, causing, for example, foaming to occur in the equipment used to treat the feed stream.

It is, therefore, an object of the invention to provide a process which is capable of removing sulfur containing compounds from gas and liquid feed streams containing these impurities without the need for a chemical reaction to convert the compounds to a more easily removable form.

It is a further object of the invention, in the case of hydrocarbon feed streams, to provide such a process which does not require the use of solvents that solubilize valuable hydrocarbons together with the sulfur compounds.

It is yet another object of the invention to provide such a process which utilizes an absorbent that is readily regenerable simply by heating and/or stripping.

It is still another object of the invention to provide a process which is highly selective for the removal of sulfur compounds having sulfur in the (−2) oxidation state while not significantly absorbing $CO_2$ that may also be present in the feed stream.

SUMMARY OF THE INVENTION

The invention meets these objects by providing a process which utilizes a regenerable absorbent that is selective essentially exclusively for sulfur compounds including sulfur in the (−2) oxidation state. According to the process taught by the invention, a feed stream containing at least one sulfur compound including sulfur in a (−2) oxidation state is contacted with a metal cation-containing organic composition to form with the sulfur compound a plurality of sulfur-metal cation coordination complexes in which the oxidation state of the sulfur and the metal cation remains essentially unchanged. The complexes are separated from the feed stream, and the absorbent is then regenerated by disassociating the sulfur compound from at least some of the plurality of coordination complexes. At least a portion of the regenerated absorbent is then recovered for additional use in removing sulfur compounds which include sulfur in an oxidation state of (−2) from a feed stream containing such compounds.

As presently understood, and without intending to limit the scope of the present invention, it is believed that the absorbent utilized in the process functions essentially as a Lewis acid (electron acceptor) to form with the sulfur compound, acting as a Lewis base (electron donor), the sulfur-metal cation coordination complexes in which neither the metal cation nor the sulfur exhibits any permanent change in formal oxidation state. By essentially maintaining the oxidation state of the metal cation and the sulfur unchanged through a complexation mechanism, the sulfur compound can be separated from the absorbent, and the absorbent thereby regenerated, by simple thermal treating and/or stripping.

Preferably, the sulfur compound is contacted with an absorbent comprising a metal cation-containing phthalocyanine or porphyrin composition capable of forming sulfur-metal cation coordination complexes with sulfur compounds containing sulfur in a (−2) oxidation state. Most preferably, the absorbent comprises a metal cation-containing phthalocyanine composition wherein the metal cation is either iron or copper.

In a preferred embodiment of the invention, the absorbent is dissolved in water or dissolved or suspended in any one of a number of solvents commonly employed in a variety of known processes used to treat feed streams, particularly hydrocarbon feed streams, contaminated with acid gases such as $CO_2$ and $H_2S$ and containing sulfur compound having sulfur in the (−2) oxidation state. Such known solvents include aqueous amine solutions which usually include one or more alkanolamines, such as triethanolamine (TEA), methyldiethanolamine (MDEA), diethanolamine (DEA), monoethanolamine (MEA), diisopropanolamine (DIPA), hydroxyaminoethyl ether (DGA), and piperazine. Known organic solvents include those comprising a mixture of dialkyl ethers of polyalkylene glycols, such as SELEXOL solvent. The absorbents taught by the invention may also be used with other well known aqueous and organic solvents typically used in the art to treat contaminated liquid and gas feed streams.

DETAILED DESCRIPTION OF THE INVENTION

Figure 1:
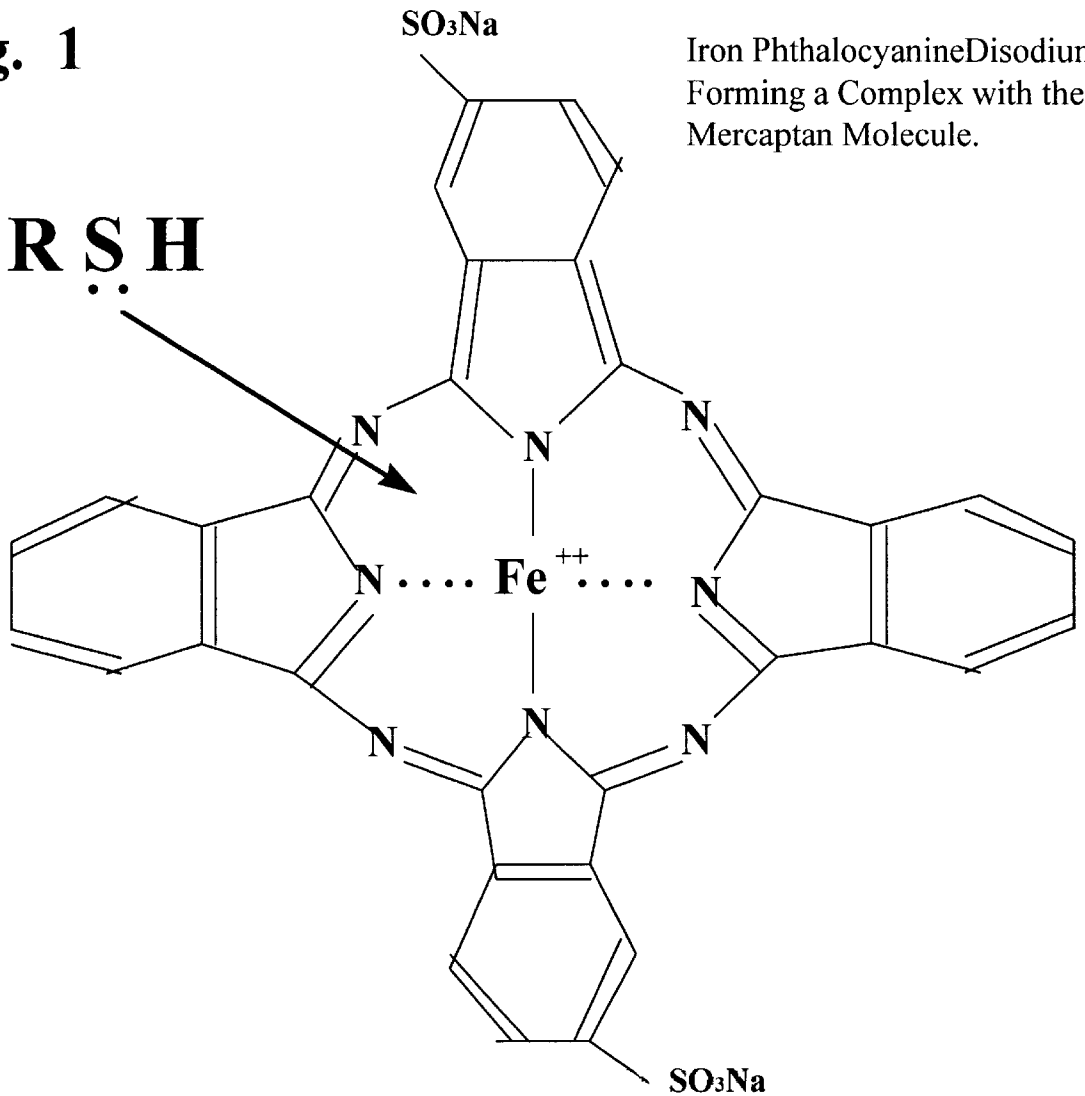
FIG. 1 is a schematic representation of a sulfur-iron phthalocyanine coordination complex formed in the process taught by the invention.

As noted above, the present invention may be used to treat a variety of gas or liquid feed streams. The invention will be described in detail, however, in connection with the treatment of gas or liquid hydrocarbon feed streams. The gas or liquid hydrocarbon feed streams treated in accordance with the present invention can be derived from a variety of sources, such as hydrocarbon containing effluent or product streams from coal gasification processes, hydrocarbon product streams from petroleum refining, natural and refinery gas streams, etc. These streams are typically composed of hydrocarbons having from 1 up to about 24 carbon atoms and can contain paraffins, aromatics and a proportion of mono- and/or di-olefins.

Typically, hydrocarbon streams derived from the above-mentioned sources contain sulfur impurities including one or more sulfur compounds which contain sulfur in a (−2) oxidation state. The concentration of these impurities can range from less than 10 ppm to more than 5000 ppm, depending upon the origin or process from which the hydrocarbon streams are generated. These compounds can include, mercaptans (designated generally as R—SH compounds, where R is any linear or branched alkyl or aryl group, such as methyl mercaptan, ethyl mercaptan, propyl mercaptan and mixtures thereof), dialkyl sulfides (designated generally as $R_1$—S—$R_2$ compounds, where each of $R_1$ and $R_2$ can be any linear or branched alkyl or aryl group, such as diethyl sulfide or methyl ethyl sulfide), carbonyl sulfide (COS) and carbon disulfide ($CS_2$), hydrogen sulfide ($H_2S$), thiophenes and benzothiophenes. $H_2S$ can be present in amounts up to 80 mole percent and typically from about 1 to 50 mole percent.

As discussed above, the absorbents employed in the process of the present invention (also referred to herein as sulfur selective absorbents or SSA molecules) selectively remove sulfur compounds which include sulfur in the (−2) oxidation state, to the exclusion of essentially any hydrocarbon contained in the stream and, largely, to the exclusion of other impurities. As such, these sulfur selective absorbents are capable of being utilized in quantities which can substantially reduce the concentration of sulfur compounds, on a practical commercial scale, from hydrocarbon streams containing the same. As used herein, the terms "absorb-and absorption" are intended to mean the act of removing these sulfur compounds from a gas and/or a liquid by complexation with a metal cation-containing organic composition which acts as a substrate for the formation of sulfur-metal cation coordination complexes. The complexation mechanism encompasses what would be thought of as classical absorption of a particular constituent from a gas stream and as classical extraction of a particular constituent from a liquid stream.

As noted above, the process taught by the invention is believed to operate according to the following mechanism. The sulfur atom in the (−2) oxidation state has a lone electron pair that behaves as a moderately strong Lewis base (electron donor) and the metal cations are acids in the Lewis definition (electron acceptors). The affinity of the absorbents employed in the process for sulfur in the (−2) oxidation state is dictated in significant part by the metal cation used in the metal cation-containing organic composition. The metal cation must enable the formation of stable sulfur metal-cation coordination complexes which exhibit sufficient sulfur to metal binding strength to permit effective removal of the sulfur compound from the hydrocarbon stream. The metal cation must also bind to the sulfur compound without effecting a change in the oxidation state of the sulfur and without the oxidation state of the metal cation itself being changed. At the same time, the sulfur to metal binding strength must have a value which enables rapid regeneration of the absorbent by heating and/or stripping. That is, upon exposure of the sulfur-metal cation coordination complexes to heating and/or stripping, the sulfur to metal binding strength must be sufficiently low to permit the sulfur and the metal cation to readily disassociate to thereby regenerate the absorbent.

In general, metal cations selected from Groups 8–15 of the Periodic Table of the Elements are suitable for use in the absorbents employed in the process taught by the present invention. Preferably, the metal cation is in a lower oxidation state, typically (+2) or (+3). Iron (Fe), copper (Cu), lead (Pb), nickel (Ni), tin (Sn), zinc (Zn) and mercury (Hg) are preferred, and in the most preferred embodiment of the invention, the absorbent includes either Fe or Cu as the metal cation.

The affinity of the metal cations for sulfur in the (−2) oxidation state is illustrated by the sulfides they form. These sulfides are, in general, highly insoluble. Consequently, it is necessary that the metal ion be complexed with an organic ligand or chelating agent in order to form a metal cation-containing organic composition that will enable the metal cation to remain in solution and thus provide a practical, thermally regenerable absorbent. As known to those skilled in the art, a chelating agent is a molecule which has more than one coordinating or ligand functionality capable of coordinating with one metal cation, thereby giving a metal cation-containing organic composition in which the metal cation and the organic molecule are more firmly bound together. As used herein, the single term "ligand" will be used both in the disclosure and in the claims to denote either a ligand or a chelating agent. It should also be understood that the invention is not limited to a process wherein the absorbent is in solution, but also encompasses a process wherein the absorbent is in suspension in another liquid, such as in a slurry with a solvent.

The ligand must be a sufficiently strong complexing agent to protect the metal cation from being precipitated as sulfide or hydroxide, while at the same time allowing the metal cation to coordinate with the sulfur compound. The organic composition formed between the metal cation and the organic ligand results from the formation of coordination bonds between the cation and the ligand. As noted previously, phthalocyanine and porphoryn compositions are the preferred ligands, although other organic ligands capable of complexing with the metal cation and protecting it from precipitating may be used.

In the case where water is used as a solvent medium for the absorbent, aquo complexes will usually form, while in aqueous amine solutions, amine (or perhaps hydroxo) complexes will be likely. The coordination stability constant of the sulfur species to be absorbed must be somewhat larger than that of the species presented by the medium in order for absorption to be favored at lower temperatures, and yet, the stability constant must be small enough for desorption to occur at higher temperatures during regeneration. The kinetics of the ligand exchange must also be fast enough so as not to unduly inhibit the approach to equilibrium.

Substituents may be used in conjunction with the organic ligands in order to further improve the solubility of the absorbents in the different solvents with which the absorbents may be used to treat hydrocarbon streams in accordance with the invention. The metal cation-containing organic composition may be in the form of salts of the substituents employed in conjunction therewith. Particularly suitable compounds for use in treating gaseous hydrocarbon containing streams are alkali or alkaline earth metal salts of metal phthalocyanine sulfonic acid, especially the sodium salt thereof. When used as salts, these compounds are solubilized in aqueous solvents. Especially suitable solvents are UCARSOL solvents available from Union Carbide Corporation, Danbury, Conn. Other substituents that may be considered useful for preparing water soluble phthalocyanine derivatives include, for example, phenol, ethoxylated phenol, hydroxyalkyl, quaternary ammonium, carboxylic acids and their salts, and amino substituents. Improved solubility of the absorbents in organic solvents may be obtained by, for example, alkyl or polyether substituents. In addition to modifying the solubility of the absorbent, the substituents on the ligand can be used to modify the activity of the absorbent in complexing with and removing sulfur compounds including sulfur in the (−2) oxidation state.

Figure 2:
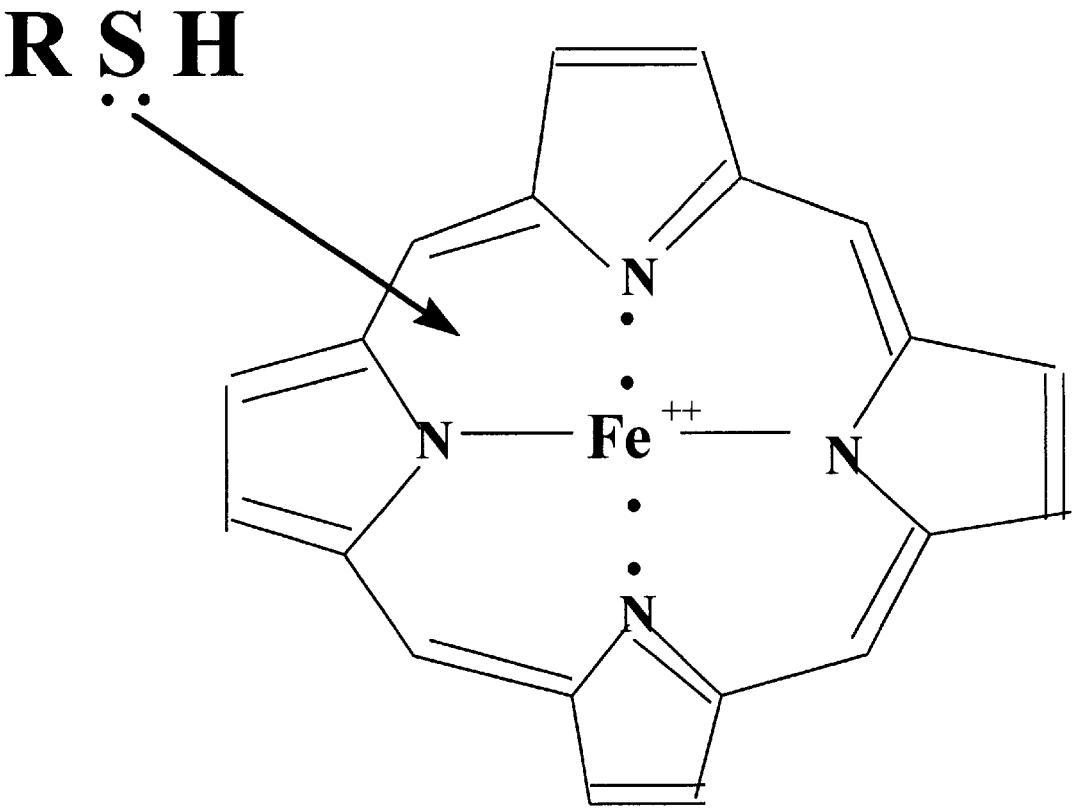
FIG. 2 is a schematic representation of a sulfur-iron porphine coordination complex formed in the process taught by the invention.

Particularly preferred metal cation-containing organic compositions used in the process taught by the invention are shown in FIGS. 1 and 2. FIG. 1 schematically illustrates a mercaptan-phthalocyanine disulfonate disodium salt coordination complex formed between a mercaptan molecule acting as a Lewis base and an iron-phthalocyanine disodium sulfonate composition acting as a Lewis acid. FIG. 2 schematically illustrates a mercaptan-porphine coordination complex with mercaptan again acting as a Lewis base and an iron-porphine composition acting as a Lewis acid.

Prior art absorbents, such as solutions of alkanolamines, do not form coordination complexes with sulfur impurities contained in hydrocarbon streams. For example, alkanolamines with a pKa in the range of about 8.5 to about 9.8 absorb $H_2S$ by salt formation, wherein the $H_2S$ acts as a Bronstead acid, that is, an acidic proton is transferred from the acid to the basic nitrogen atom of the amine to form the salt. Moreover, alkanolamines are unable to absorb dialkyl sulfides, since these compounds lack an acidic proton. Alkanolamines are also very inefficient in absorbing thiols (mercaptans) which have pKa's above 10, and are thus very weakly acidic. Thus, the present invention provides a mechanism for removing a variety of sulfur compounds containing sulfur in the (−2) oxidation state, which either could not be removed with prior art techniques to any effective degree, or which required a change in the oxidation state of the sulfur atom, thus forming a different sulfur compound, to effect removal.

The concentration of absorbent employed in the present invention varies widely depending upon such factors as the concentration and partial pressure of the sulfur compounds to be removed from the gas or liquid, the operating environment in which the contact and complexation is to occur, and the composition of the solvent employed with the SSA molecule. Typically, the absorbents are in solution at concentrations in the range of from about 0.05 wt % to about 15 wt % of the solvent employed, and preferably are present in an amount between about 0.2 wt % to about 10 wt %, and most preferably in an amount between 0.5 wt % and 5 wt %.

Figure 3:
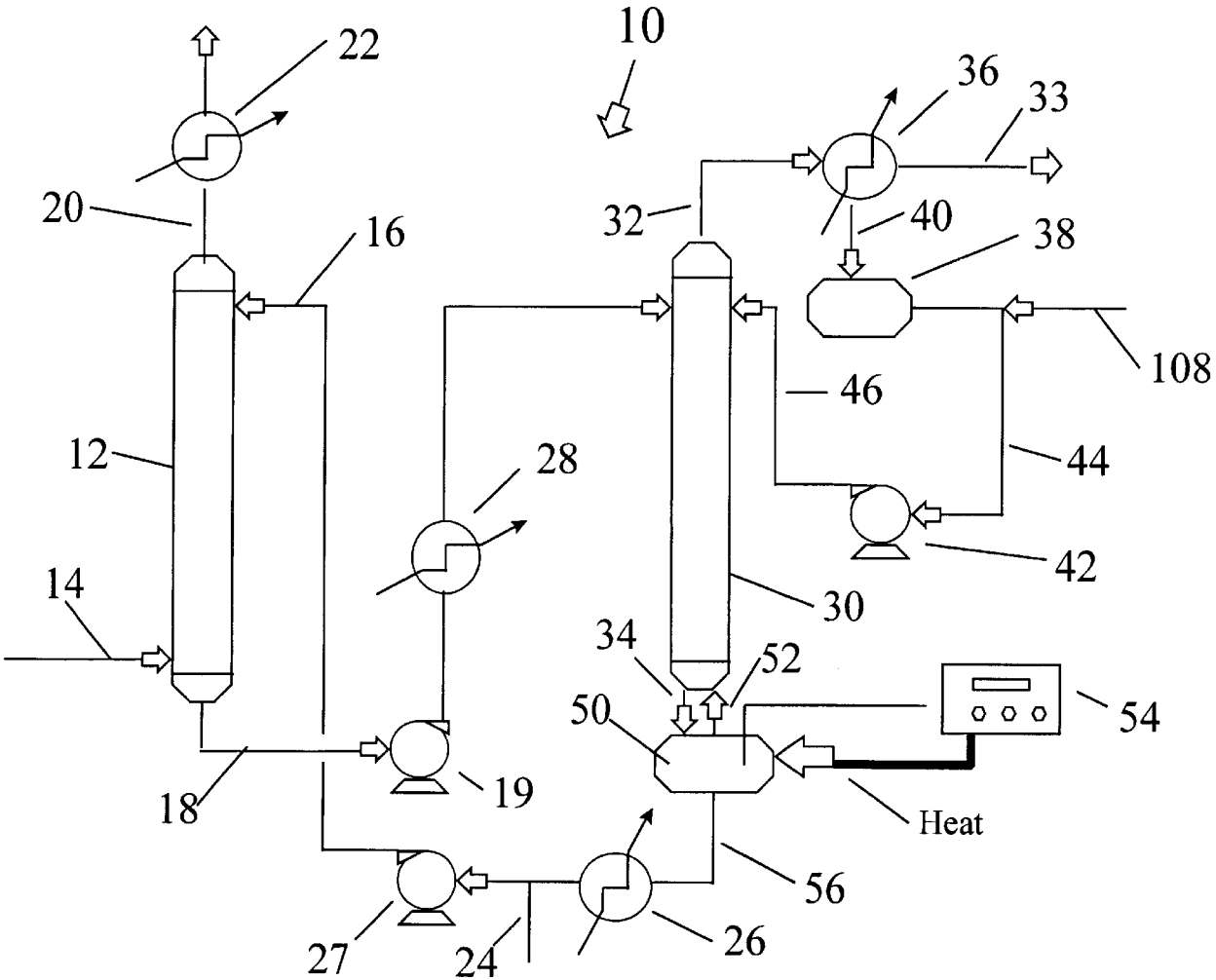
FIG. 3 is a block flow diagram of an apparatus useful in carrying out the process of the present invention.

FIG. 3 schematically illustrates an apparatus useful for performing the process of removing sulfur compounds from hydrocarbon streams taught by the invention. The process will be described in detail in conjunction with a description of the illustrated apparatus. Before turning to the illustrated apparatus in detail, however, it should be understood that while the particular apparatus shown in FIG. 1 may be used to remove sulfur containing impurities from gaseous hydrocarbon feed streams, those skilled in the art will readily appreciate how to modify the apparatus to permit the removal of sulfur compounds from liquid hydrocarbon feed streams. For example, those skilled in the art will appreciate that to treat a liquid hydrocarbon stream the apparatus illustrated in FIG. 3 can be modified by replacing the absorption column, which forms a component of the apparatus, with a liquid-liquid contacting device such as that shown in Kohl, A. L. and Nielsen, R. B., "Gas Purification" $5^{th}$ ed., Gulf Publishing Company, p. 158, FIGS. 2–96 (1997).

As shown in FIG. 3, the apparatus, generally designated 10, includes an absorption column 12 where the absorption of sulfur compounds from a gaseous hydrocarbon feed stream takes place. The hydrocarbon feed stream contaminated with sulfur containing compounds is introduced into a lower portion of the absorption column 12 via line 14, and lean absorbent solubilized in an aqueos solvent is introduced into an upper portion of the absorption column by line 16.

The construction of the absorber column is not critical. The absorber will contain a sufficient number of trays, or sufficient packing material if a packed column, to ensure intimate contact between the gaseous and liquid phases. The number of trays may vary within a wide range but generally will be in the range of about 5 to about 50. As the absorbent travels from tray to tray down the absorption column, it comes into intimate contact with the gaseous hydrocarbon stream flowing upwards through the column, the intimacy of contact therebetween affecting the degree of removal of the sulfur compounds present in the stream by the complexation mechanism described above.

The sulfur compound enriched absorbent that results from carrying out the absorption step is removed from the bottom of the absorption column by line 18, and the sulfur reduced hydrocarbon stream produced by the absorption step exits from the top of absorption column 12 via line 20. The reduced hydrocarbon stream is directed to a condenser 22 where any vaporized solvent or water vapor exiting the absorption column with the reduced hydrocarbon stream is condensed.

Fresh or regenerated absorbent is supplied to the absorbent column at a first temperature. The temperature at which the absorbent is supplied depends upon the particular absorbent being used, its concentration in the solvent, the temperature and composition of the hydrocarbon feed stream, the design of the absorption column, and the desired degree of sulfur compound removal from the hydrocarbon stream being treated. The first temperature is generally in the range of about 0° C. to about 80° C., with a temperature in the range of about 5° C. to about 60° C. being preferred, and a temperature in the range of about 15° C. to about 40° C. being the most preferred.

The temperature within the absorption column is partially controlled by the temperature of the of the lean absorbent entering through line 16. Cooler 26 is provided to cool the lean absorbent to an appropriate temperature before it is pumped into the absorption column by absorbent pump 27. A device (not shown) for measuring the temperature of the sulfur lean absorbent entering the absorber through line 16 and the temperature of the sulfur enriched absorbent leaving the bottom of the absorption column through line 18 is also provided. In addition, the absorbent of pump 27 is supplied with fresh/makeup and/or regenerated absorbent through line 24 to maintain an appropriate level of absorbent in the system.

Absorbent is supplied to the absorption column at a rate which depends not only upon the flow rate of the hydrocarbon stream to be treated, but also on such factors as the number of trays in the absorption column, the temperature in the column, the specific absorbent being used, the particular sulfur compounds contained in the hydrocarbon stream, and the partial pressure and concentrations of those compounds. Typically, the absorbent will be supplied at a rate sufficient to establish in the exit gas stream from the absorber (or in the liquid hydrocarbon stream exiting the liquid-liquid contacting device) a concentration of sulfur compound that meets the sulfur specification of the product gas or liquid stream leaving the process. In some applications this can be 500 ppmv or higher, but generally this is not more than about 300 ppmv of sulfur compounds, preferably not more than about 200 ppmv of sulfur compounds, and most preferably as low as from about 1 to about 50 ppmv of sulfur compounds.

The pressure at which the absorption step is conducted is not critical and is usually determined by the available feed gas pressure. Typically, the pressure in the absorber is in the range of from about atmospheric pressure to about 1500 psig.

The sulfur rich absorbent leaving the bottom of the absorption column through line 18 and absorbent pump 19 is directed to heater 28 where the absorbent is heated to an appropriate temperature before being introduced into an upper portion of stripper column 30. The absorbent is regenerated in the stripper column by removing the sulfur containing compound from the sulphur-metal cation coordination complexes formed in the absorption stage. Like the absorber column 12, the stripper column 30 is of a well-known design and can be configured to include any number of trays as may be appropriate for the particular absorbent to be regenerated.

The stripped sulfur compounds exit the top of the stripper column via line 32 and are directed to a condenser 36 where any absorbent and/or water vapor that may leave the top the stripper column together with the stripped sulfur compounds are condensed. The stripped sulfur compounds are discharged from the condenser to line 33 for further down stream processing, and any condensed absorbent, liquid sulfur compounds that may have condensed, and/or water vapor are passed to a water receiver 38 via line 40. The condensed liquid sulfur compounds can be decanted from the aqueous phase in receiver 38. An initial water charge is introduced into water receiver 38 through line 108 at the beginning of the run. Line 108 is also used as make-up water conduit to replace water vapors that might have escaped the system through line 33.

Water vapor refluxed to the stripper column from the receiver 38 is used to aid in stripping the sulfur compounds from the absorbent. Accordingly, the apparatus 10 includes reflux pump 42 which is connected to the water receiver 38 by line 44 and to the upper portion of the stripper column 30 through line 46. The feedpoint at which the reflux pump introduces water vapor into the stripper column is largely a function of the degree of assistance desired for the particular process conditions, the need to have a rectification section above the feedpoint, the particular absorbent employed and the desired results.

Absorbent leaving the bottom of the stripper column through line 34 passes to a reboiler 50 which is connected back to the stripper column by return line 52. Critical to the stripping step is maintaining the temperature in at least some portion of the length of the stripper column 30 or in the stripper reboiler 50 at a temperature sufficiently high to overcome the binding strength between the metal cation of the absorbent and the sulfur in the sulfur-containing compound. That is, the temperature in the stripping stage must be higher than the temperature at which the sulfur compounds were removed from the hydrocarbon feed stream and complexed with the absorbent in the absorption column 12. The preferred temperature differential will, of course, depend upon the absorbent being used, the solvent composition, and the nature of the sulfur compounds being removed. Typically, however, the differential is at least about 5° C. to ensure effective stripping of the sulfur compound from the sulphur-metal cation coordination complexes and to thereby regenerate the absorbent. Typically, the temperature in the bottom of the stripper will be maintained at a temperature at which the equilibrium begins to shift toward decomplexation. Generally, the temperature in the stripper will be maintained in the range of from about 60° C. to about 180 °C., preferably in the range of from about 90° C. to about 160° C., and most preferably in the range of from about 100° C. to about 140° C.

A controller 54, comprising a thermocouple, a heater and a temperature controller, is provided to measure and control the reboiler temperature at a desired set point and to control the temperature within the lower portion of the stripper column 30 at a desired level. Regenerated absorbent is discharged from the reboiler and is directed through line 56 to cooler 26 where, as mentioned previously, the absorbent is cooled to an appropriate temperature prior to being pumped back to the absorption column 12 by pump 27. Alternatively, cooler 26 and heater 28 can be combined into a single heat exchanger with the heat removed from line 26 used to heat the sulfur rich absorbent in line 18. In this case, an additional cooler is used to trim the temperature of stream 16 to the desired level.

The various aspects of the present invention will be more fully understood and appreciated by reference to the following examples. These examples not only demonstrate the interrelationship between the absorbents used in the process taught by the invention and certain process variables, but also the significantly improved effectiveness of the present invention in reducing sulfur compound concentrations in contaminated feed streams, as compared to prior art processes.

EXAMPLES 1–17

In Examples 1–17, a known amount of pure solvent (no SSA added) is weighted into a flask equipped with a sparger and an overhead condenser to prevent any vapors from escaping from the apparatus. Methyl mercaptan (MeSH) gas is then bubbled through the sparger until the absorption of the methyl mercaptan stops, that is the solution does not gain any more weight. The purpose of this first experimental step is to determine the absorption of methyl mercaptan by the pure solvent, without any SSA present. At this point, a known amount of SSA is added to the solvent and the sparging of methyl mercaptan is continued until the solution stops gaining weight again. The additional weight of mercaptan gained is due to the effect of the SSA additive. The results of the experiments are expressed as the ratio of moles of methyl mercaptan absorbed per mole of additive present in the solvent. The experiments were conducted at atmospheric pressure (approximately 14.7 psia). A number of different SSA molecules having various metal cations which complex with different organic ligands (for example, phthalocyanines and porphine) which may have various substituents (for example, sulfonic acid, sodium sulfonate and chlorine) are reported. Also, different solvent mediums such as the organic SELEXOL solvent and various aqueous amines mixtures were tested. These examples show that the solvent medium, the type of molecule complexing with the metal cation as well as the substituents attached to the SSA molecule affect the absorbent's ability to actively remove (complex with) impurities containing sulfur in the (−2) oxidation state.

Table 1 reports the results of experiments conducted using the equipment described above.

The first column of the table describes the particular data reported for each example which is set out in a separate column extending from left to right across the table. Definitions of the types of data being reported are as follows:

Example No: Identifies each example performed with a specific number.

SSA Molecule: Describes the structure, in shorthand form, of an absorbent added to a particular solvent for the purposes of conducting the example. For instance, in the case of NiPC4SNa (Nickel(II) phthalocyaninetetrasulfonic acid, tetrasodium salt), Ni refers to the metal cation with the (+2) oxidation state, PC stands for phthalocyanine, and 4SNa for tetrasulfonic acid tetra sodium salt.

Wt % SSA in solvent: The weight percent of active SSA in the indicated solvent.

Solvent (100 g): Indicates the type of solvent used and that 100 grams grams of solvent was used for each of the experiments.

Loading moles MeSH/mole SSA: Gives the results of the experiment in moles of methyl mercarptan (MeSH) absorbed per mole of SSA at the experimental conditions (50° C. and 1 atm).

Regeneration Cycles: Indicates the number of times the SSA molecule was regenerated by boiling steam through the SSA/solvent mixture and used again to absorb MeSH.

In examples 1 through 5, different SSAs were added to SELEXOL solvent, a pure physical solvent effective in high pressure acid gas treatment available from Union Carbide Corporation, Danbury, Conn. In these experiments the SSA was not in solution but was suspended in SELEXOL solvent to form a slurry.

Examples 1, 2 and 3

NiPC4SNa was not active in removing MeSH in pure SELEXOL solvent as shown in Example 1, but removed 2.1 moles of MeSH per mole of NiPC4SNa in Example 2 when 4.6 grams of water were added to the SELEXOL solvent. The weight percent SSA was about the same in both examples, 10.1 and 10.5 weight percent, respectively. The performace of NiPC4SNa, and SSAs in general, is also affected by the medium in which it is dissolved or contained. In this case, the addition of a small amount of water to SELEXOL solvent activated the NiPC4SNa molecule. In Example 3, 10.1 weight percent SnPC4SNa (Tin(II) phthalocyaninetetrasulfonic acid, tetrasodium salt) was active in SELEXOL solvent even without the addition of water and removed 1.9 moles of MeSH per mole of SnPC4SNa. In this experiment the SSA molecule was regenerated twice.

Example 4

In this example, 10.0 weight percent of FePC4SNa (Iron (II) phthalocyaninetetrasulfonic acid, tetrasodium salt) in SELEXOL solvent removed 5.2 moles of MeSH per mole of FePC4SNa. The FePC4SNa molecule was regenerated three times.

Example 5

In this example, the SSA molecule is composed of a Fe cation-porphine composition. Here, 4.48 weight percent of Fe-Porphine in SELEXOL solvent removed 9.5 moles of MeSH per mole of Fe-Porphine. The Fe Porphine composition was regenerated six times.

In examples 6 through 17, different SSA molecules were tested in 50 weight percent aqueous amine solutions.

Examples 6 and 7

In example 6, it was determined that 10.2 weight percent NiPC4SNa in solution with 50 weight percent aqueous N-Methyl diethanolamine (MDEA) was not active in removing MeSH. However, in Example 7 the molecule NiPC2S (Nickel(II) phthalocyaninedisulfonic acid), the same Ni cation in a PC molecule but with different substituent groups, two sulfonic acids instead of four sodium sulfonates, showed some activity by removing 0.23 moles of MeSH per mole of SSA. This indicates that the SSA performance is affected by the number and/or type of substituent groups, for example, sulfonic acid or sodium sulfonate groups, attached to the SSA molecule.

Examples 8 and 9

Example 8 shows that 9.08 weight percent ZnPC4SNa (Zinc phthalocyaninetetrasulfonic acid, tetrasodium salt) in 50 weight percent aqueous MDEA was not active in removing MeSH. In Example 9, however, the same Zn cation showed some activity when the number of substiutuents was reduced from four (tetrasulfonic acid, tetra sodium salt) in Example 8, to two substituents (disulfonic acid, disodium salt) in Example 9. As can be seen, 6.16 weight percent of ZnPC2SNa in 50 weight percent aqueous MDEA removed from 0.64 to 0.11 moles of MeSH per mole of SSA after four regenerations.

Example 10

Here, 5.1 weight percent of PbPC2S (Lead (II) phthalocyaninedisulfonic acid) in 50 weight percent aqueous MDEA removed 2 moles of MeSH per mole of PbPC2S present. In this case the SSA molecules was regenerated three times.

Example 11

In this example, the sulfonic acid substituents were converted to their sodium salt. In this example, 6.05 weight percent PbPC2Na (Lead (II) phthalocyaninedisulfonic acid, disodium salt) in 50 weight percent aqueous MDEA removed 2.1 moles of MeSH per mole of PbPC2Na but the molecule degraded and became inactive.

Example 12

In this experiment 8.3 weight percent FePC2S (Iron (II) phthalocyaninedisulfonic acid) in solution with 50 weight percent aqueous NMEA (N-Methyl Ethanolamine) showed no activity in removing MeSH.

Example 13

Here, the same SSA molecule of Example 12 was solubilized in a different amine. 9.93 weight percent FePC2S was solubilized in 50 weight percent of aqueous MDEA, and this time the FePC2S molecule removed 1.0 mole of MeSH per mole of SSA. The FecPC2S was regenerated twice.

Example 14

In this example, 6.01 weight percent FePC2SNa in 50 weight percent aqueous UCARSOL CR302 solvent, a formulated amine mixture well-known to those skilled in the art and available from Union Carbide Corporation, Danbury, Conn., removed 1.2 moles of MeSH per mole of FePC2SNa even after four regeneration of the SSA molecule.

Example 15

Here it was shown that 5.0 weight percent of CuPC3SNa in 50 weight percent MDEA remove 0.9 moles MeSH per mole of CuPC3Na after 5 regeneration cycles.

Example 16

In this experiment 5.0 weight percent CuPC2S4Cl (Copper (II) tetrachloro phthalocyaninedisulfonic acid) in 50 weight percent aqueous MDEA removed 1.0 mole MeSH per mole of CuPC2S4Cl after 5 regeneration cycles.

Example 17

In this example, 6.09 weight percent of CuPC3SNa (Copper (II) phthalocyaninetrisulfonic acid, trisodium salt) in 50 weight percent aqueous diethanolamine (DEA) removed 1.8 moles MeSH per mole of CuPC3SNa after 3 regeneration cycles.

From the data reported in Table 1, it is readily apparent that SSA concentrations from 4.48 weight percent to 10.5 weight percent in the SSA containing solvent are possible. Also, the data show that the SSAs can work in a slurry or suspension (SELEXOL solvent case), as well as in solution as shown in the aqueous amine cases. Examples 1 and 2 also show that the medium in which the SSA is dissolved or suspended plays a role in activating the SSA molecule. Examples 12 and 13 also show the importance of the medium in which the SSA is dissolved. FePC2S is not active in aqueous amine NMEA but becomes active in aqueous amine MDEA. Also influencing the activity of the SSA is the type of subsituent attached to the ligand molecule, as in the case of sodium sulfonate versus sulfonic acid in Examples 6 and 7, as well as the number of substituent groups, as in the case of four sodium sulfonates versus two in examples 8 and 9.

EXAMPLES 18–29

These examples are VLE (Vapor Liquid Equilibrium) experiments wherein various SSAs are used to remove a variety of sulfur compounds with sulfur in the (−2) oxidation state from a sweet commercial natural gas. The sweet commercial natural gas is a gas that has been scrubbed in a commercial unit with UCARSOL CR302 but has not been treated with SSA. Such a gas is referred to below as an "untreated" sweet commercial gas. The experiment consisted of placing 25 grams of 50 weight percent aqueous UCARSOL CR302 together with a known weight percent of an SSA in solution with the partially sweetened commercial natural gas in a TEFLON lined bomb at 170 psig. The CR302 solvent/SSA was allowed to come to equilibrium with the gaseous phase as the bomb with its contents was agitated from 1 to 2 hours to promote mixing. The gas phase was analyzed before and after the SSA treatment by Gas Chromatography to determine the percent removal of sulfur compounds with sulfur in the (−2) oxidation state.

Table 2 reports the results of VLE experiments conducted using the equipment and procedure hereinabove described.

The first column of the table describes the particular data reported for each example which is set out in a separate column extending from left to right across the table. Definitions of the types of data being reported are as follows:

Example No: Identifies each example performed with a specific number.

Sweet Natural Gas Description. "Untreated" refers to the sulfur analyses of a sweet commercial natural gas that has been previously scrubbed with CR302 in a commercial unit. "Treated" refers to the sulfur analyses of such a gas after being contacted with approximately 50 weight percent aqueous CR302 solvent from a commercial unit or the aqueous CR302 solvent plus the indicated weight percent amount of SSA added to the solution.

SSA Molecule Type. Describes the structure, in shorthand form, of an absorbent within the scope of the present invention added to the solvent for the purposes of conducting the example. It is the same shorthand described in more detail for Table 1, experiments 1 through 17 above.

Wt % SSA in Aqueous Solvent. The weight percent of active SSA in the aqueous UCARSOL CR302 solvent.

Times SSA was Regenerated. Indicates the number of times the SSA molecule was regenerated by boiling.

Natural Gas Impurities. Describes the sulfur compound impurities present in the natural gas sample. Under the column for each example, the concentration is given in ppmv (parts per million volume) then a slash followed by the percent removal of that particular impurity when compared with the amount present in the untreated gas.

TOTAL: At the bottom of each example column the total ppmv of all the impurities added together and the total percent removal of all the impurities as a whole is given.

The experimental result for each example is as follows:

Example 18

This example shows the results of the analyses of the untreated gas. The untreated gas has a total of 360 ppmv of sulfur compounds.

Example 19

In this experiment the untreated gas was washed with the aqueous UCARSOL CR302 solvent alone, no SSA added. This treatment is a blank experiment and is used as a reference for comparison with the removal in other examples where a weight percent amount of SSA is added to the aqueous solvent. The pure UCARSOL CR302 solvent alone removed 27% of the COS, 50% of the MeSH, etc. The total removal of sulfur compounds was 44%.

Examples 20, 21, 22 and 23 employ SSAs with copper (Cu) cations.

Example 20

In this experiment 0.2 weight percent CuPC4SNa (Copper (II) phthalocyaninetetrasulfonic acid, tetrasodium salt) was added to UCARSOL CR302 solvent. This caused the removal of 98% of the COS versus 27% with the aqueous solvent alone, 82% removal of MeSH versus 50% with the solvent etc. The total removal of sulfur compounds with the addition of 0.2 weight percent CuPCSNa was 60% versus 44% with the solvent alone, a 36% improvement in sulfur removal.

Example 21

In this experiment the amount of CuPC4SNa was increased from the 0.2 weight percent in Example 20 to 1 weight percent. As a result, the total removal of sulfur compounds went up to 80 percent removal, an 82 percent increase from Example 19 (no SSA) and a 33 percent increase when compared with Example 20 (0.2 weight percent SSA).

Example 22

In this example, the solvent in Example 21 with 1 weight percent CuPC4SNa was regenerated and used again. The total removal of sulfur compounds with the regenerated 1 weight percent CuPC4SNa was 74 percent, only slightly lower than that of Example 21 with 80 percent removal, and 68 percent higher removal than that of Example 19 (no SSA).

Example 23

In this example the weight percent of CuPC4SNa was increased to 5 weight percent. At this higher SSA concentration the sulfur compound removal went down from 80 percent in Example 21 to 45 percent in this example. This indicates that there is also an optimum concentration of SSA for each particular solvent.

Examples 24, 25 and 26 employ SSAs with iron (Fe) cations.

Example 24

In this example the metal cation in the SSA molecule was changed from Cu to Fe. The addition of 0.2 weight percent FePC4SNa to the plant solvent resulted in a total removal of sulfur compounds of 80%. This is equivalent to the removal obtained with the 1 weight percent CuPC4SNa in Example 21, and 82% more removal than in Example 19 (no SSA).

Example 25

In this example, the SSA content of the solvent was increased to 1 weight percent FePC4SNa from the 0.2 weight percent in Example 24. This resulted in a 69 weight percent total sulfur removal, which is an 11% lower total sulfur removal than in Example 24 with 0.2 weight percent SSA. Still, this is a 56 percent higher removal than in Example 19 with no SSA. It appears that the 1 weight percent of FePC4SNa in the solvent is higher than the optimum amount for this SSA under these experimental conditions.

Example 26

Here, the concentration of FePC4SNa in the solvent was increased to 5 weight percent. The percent of total sulfur compound removal increased slightly from the 69% in Example 25 to 76% in this example.

Examples 27, 28 and 29 employ SSAs with lead (Pb) cations.

Example 27

This experiment with 0.2 weight percent PbPC4SNa in the solvent showed a removal of 75% of the sulfur compounds in the gas. That is higher than with CuPC4SNa with 60% removal and lower than the FePC4SNa with 80% removal. These results indicate that at these experimental conditions and 0.2 weight percent concentration, iron (Fe) is the best of the three cations tested.

Example 28

Here, 1 weight percent of PbPC4SNa in the solvent provided 65% removal of sulfur compounds. That is lower than CuPC4SNa (80% removal) and FePC4SNa (69%) at the same concentration. These results indicate that at 1 weight percent concentration and under these experimental conditions, copper (Cu) is the best of the three cations.

Example 29

In this experiment the concentration of PbPC4SNa was increased to 5 weight percent. This resulted in a total removal of sulfur compounds of 88%. At the 5 weight percent SSA concentration in the solvent, lead (Pb) is the best cation for the total removal of sulfur compounds from the gas phase.

In summary, it can be seen clearly that there is a much higher removal of COS and the other various mercaptans when SSA is added to the aqueous UCARSOL CR302 solvent than with the aqueous solvent alone. The examples show a few ppmv increase in concentration of the disulfides. It is theorized that this anomaly is either an analytical problem, or that it results from a few ppmv of the mercaptans being converted to disulfides as a result of oxidation by the adventitious oxygen from air that may have contaminated the sample.

EXAMPLES 30–52

These experiments were conducted in a unit made of glass which is similar to the one shown in FIG. 3. The major components of the unit used to conduct Examples 30 to 52 are an absorber and a stripper, with absorption, stripping and regeneration being conducted in a closed loop arrangement.

Absorption of the sulfur compound from nitrogen feed gas takes place in a 28 mm ID glass column with 5 or 20 perforated trays approximately 26 mm apart. The absorber column is equipped at the bottom with a 3 neck 1000 ml flask with a bottom liquid outlet. The column is connected to the center neck. One side neck is used to introduce the sulfur compound containing hydrocarbon feed gas to the absorber column, and the other side neck is used to measure the sulfur compound enriched absorbent temperature. The enriched absorbent leaves the absorber column by passing through the flask bottom outlet. One neck of a 3 neck adapter is attached to the top of the absorber column. A Friedrich condenser is attached to a second neck of the adapter and is used to condense any water or absorbent solvent vapor that might exit the absorber column with the treated gas. The third neck of the adapter functions as in inlet to supply regenerated/fresh absorbent at the top of the absorber.

The regeneration/stripping of the sulfur compounds from the absorbent takes place in the stripper column. The stripper column has the same dimensions as the absorption column. Similarly, it is equipped at the bottom with a 3 neck, 1000 ml flask equipped with a heating mantle and a liquid bottom outlet, all of which has the function of a reboiler for the stripper column. The stripper column is attached to the center neck of the flask. Another neck is capped with a glass stopper and the remaining neck has a thermocouple attached to it. The thermocouple is a part of a TIC (Temperature Indicator Controller) that reads and controls the stripper bottom temperature at the desired set point. A more recent upgraded version of this unit has a 316SS reboiler equipped with an immersion heater to supply heat to the reboiler. It also has a much more sophisticated temperature controller that keeps the reboiler temperature within 0.05° C. of the desired temperature.

The top of the stripper column is equipped with a 3 neck adapter. One neck holds a Friedrich condenser that provides reflux to the column and condenses any absorbent solvent or water vapors that may leave overhead with the stripped sulfur compounds. A second neck is used to introduce into the stripper the enriched absorbent removed from the bottom of the absorber. A third neck has attached to it, in order to maintain the water balance in the unit, a 250 ml graduated cylindrical separatory funnel, full of water. In the upgraded version of this unit, the reflux water condensed in the Friedrich condenser discharges into the 250 ml graduated cylinder and a very accurate positive displacement pump is used to reflux the water back into the top of the stripper. This allows much better control of the amount of water used to reflux the stripper column. Water is added or removed from the 250 ml graduated cylinder as required to maintain the water balance in the system. A 9 inch stem thermometer, also associated with the third neck, is used to measure the temperature of the overhead vapors before leaving the stripper column through the Friedrich condenser.

Water cooling is employed to control the temperature of the regenerated absorbent leaving the bottom of the stripper column. A variable speed FMI metering pump is used to deliver the desired amount of absorbent to the top of the absorber column. Sulfur compound enriched absorbent is withdrawn from the bottom of the absorber column via a second variable FMI metering pump. The enriched absorbent passes through a heater before being supplied to the stripper column. The metering pump also controls the level of solvent in the absorber bottom.

The flow of sulfur compound containing hydrocarbon gas (nitrogen in these experiments) to the bottom of the absorber is measured in standard liters per minute at 1 atm and 70° F. using gas meters from AALBORG Instruments & Controls. The concentration of mercaptan (the sulfur compounds used in the examples) in nitrogen (nitrogen being used always as a diluent gas in these experients) was measured with Drager tubes. Drager tubes were also used to measure the concentration of mercaptan in the treated gas.

Table 3 reports the results of experiments conducted using the equipment hereinabove described. All the experiments were run at least 4 to 6 hours (10 to 25 SSA regeneration cycles) to ensure that steady state had been achieved. A regeneration cycle is defined as one pass of the entire quantity of SSA containing solvent through the absorber and stripper (regenerator) columns to complete one flow cycle around the unit.

The first column of the table describes the particular data reported for each example which is set out in a separate column extending from left to right across the table. Definitions of the types of data being reported are as follows:

Example No: Identifies each example performed with a specific number.

SSA Molecule Type. Describes the structure, in shorthand form, of an absorbent within the scope of the present invention added to the solvent for the purposes of conducting the example. For instance, in the case of CuPC3SNa, Cu refers to the metal cation with the (+2) oxidation state, PC stands for phthalocyanine and 3SNa for trisulfonic acid trisodium salt.

Wt % SSA in Solvent. Weight percent of active SSA molecule in the recited solvent.

Wt % Amine in Water. Weight percent of amine in the recited aqueous solvent.

Solvent Rate (CC/Min). Flow rate of the lean aqueous amine solvent in cubic centimeters per minute.

$N_2$ Feed Gas Rate(SL/Min). Flow rate of the sulfur laden nitrogen gas (as a diluent), to the absorber column in standard liters per minute where the standard temperature is 70° F. and the standard pressure is 14.7 psia.

L/G Ratio (CC/SL). The ratio of the Solvent Flow Rate divided by the Feed Gas Flow Rate in cubic centimeters of solvent per standard liter of gas at 70° F. and 1 atmosphere.

Absorber Pressure (psia). Absolute pressure in the absorber column.

Solvent Temperature (° C.). Temperature of the lean aqueous amine/ SSA solution in the absorber column in degrees Celsius.

Absorber No of Trays. Number of actual trays in the absorber column.

Stripper Top Temp. (° C.). Temperature of the vapors leaving the stripper overhead before the overhead condenser in degrees Celsius.

Stripper Reboiler Temp. (° C.). Temperature of the solvent in the reboiler at the bottom of the stripper in degrees Celsius.

Stripper No of Trays. Number of actual trays in the stripper column.

EthSH in Feed Gas (ppmv). The concentration of the prototype mercaptan, ethyl mercaptan (EthSH), in volume parts per million in the nitrogen feed gas to the absorber to produce the sulfur compound containing gas.

EthSH in Treated Gas (ppmv). The concentration of the prototype mercaptan, ethyl mercaptan (EthSH), in volume parts per million in the sulfur compound containing nitrogen gas as it leaves the absorber overhead after being contacted or treated with the SSA containing solvent.

EthSH Percent Removal. Percent removal of the prototype mercaptan (EthSH) from the Feed Gas with the SSA containing solvent to produce a Treated Gas of lower EthSH content.

SSA Dosage (molesSSA/molesEthSH). These are the moles of SSA being introduce into the absorber with the SSA containing solvent per unit time, divided by the moles of EthSH being introduced into the absorber with the EthSH containing nitrogen feed gas per unit time. The dosage can be increased by adding more SSA to the solvent, that is, increasing the weight percent SSA in the solvent (aqueous amine in this case) or, alternatively, increasing the L/G Ratio.

SSA Loading (molesEthSH/molesSSA). This represents the moles of EthSH removed from the EthSH containing nitrogen gas per unit time, divided by the moles of SSA being introduced into the absorber with the SSA containing solvent per unit time.

The following three data lines were added at the bottom of the table for Examples 49 to 54 to show the result for the simultaneous removal of $H_2S$ and EthSH from the feed gas.

Vol % $H_2S$/ppmv EthSH in Feed Gas. The volume percent concentration of $H_2S$ separated by a slash from that of the prototype mercaptan, ethyl mercaptan (EthSH), in volume parts per million in the sulfur compound containing nitrogen feed gas to the absorber to produce the sulfur compound containing gas.

Vol % $H_2S$/ppmv EthSH in Treated Gas. The volume percent concentration of $H_2S$ separated by a slash from that of the prototype mercaptan, ethyl mercaptan (EthSH), in volume parts per million in the sulfur compound containing nitrogen gas as it leaves the absorber overhead after being contacted or treated with the SSA containing solvent.

Percent Removal $H_2S$/EthSH. Percent removal of $H_2S$ separated by a slash from the percent removal of the prototype mercaptan (EthSH) from the Feed Gas with the SSA containing solvent to produce a Treated Gas of lower $H_2S$ and EthSH content.

Examples 30 to 33

These examples show the effect of the FePC2SNa concentration in water on the removal of EthSH from a nitrogen gas. It should be noted that the SSA Dosage of FePC2SNa is being changed by increasing the weight percent of the SSA in the water solvent, since the L/G ratio of 46 is the same for all examples Example 30 is a run with pure water, zero SSA Dosage. Water alone removed 36 percent of the EthSH present in the feed gas. In Example 31, 0.1 weight percent FePC2SNa was added to the water solvent representing a dosage of 1.3 molesSSA per mole of EthSH. This resulted in an increase of EthSH removal from 36 percent with water alone in Example 30 (zero dosage), to 60 percent removal in this example, an increase of 67 percent. This resulted in an SSA loading of 0.23 molesEthSH per mole of SSA. In Example 32, 1.0 weight percent FePC2SNa was added to the water, increasing the dosage to 13 molesSSA per mole EthSH. At this dosage, the EthSH removal was 100%. Example 33 is a repeat of Example 32. The results are the same. At 13 molesSSA per mole of EthSH the mercaptan removal is 100 percent.

Examples 34 to 38

These examples show the effect of the FePC2SNa concentration in aqueous MDEA (N-Methyl Diethanolamine) on the removal of EthSH from a nitrogen feed gas. In all these experiments the liquid to gas ratio (L/G Ratio) is 2.5 CC/SL, considerably lower than the 46 CC/SL used in the Examples 30 to 33 set of experiments above. It should also be noted that the dosage of FePC2SNa is being changed by increasing the weight percent of the SSA in the aqueous MDEA solvent since the L/G ratio of 2.5 is the same for all examples. Aqueous MDEA instead of pure water is used as solvent in all these examples.

In Example 34 the removal is done with aqueous MDEA alone, zero SSA dosage. Aqueous MDEA alone removed 40 percent of the EthSH present in the nitrogen feed gas. In Example 35, 0.09 weight percent FePC2SNa was added to the aqueous MDEA solvent representing a dosage of 0.068 molesSSA per mole of EthSH. This resulted in an increase of EthSH removal from 40 percent with aqueous MDEA alone in Example 34 (zero dosage), to 45 percent removal in this example, an increase of about 12 percent. The SSA loading in Example 35 was 0.74 molesEthSH per mole of SSA, after taking into account the EthSH removed by the aqueous MDEA solvent alone. In Example 36 the FePC2SNa concentration was increased to 0.25 weight percent to an SSA dosage of 0.19 moles of FePC2SNa per mole of EthSH. This resulted in a removal of 50 percent EthSH, an increase of 5 percent removal over that in Example 35. The SSA loading in this example went down to 0.54 moles EthSH per mole of FePC2SNa.

Examples 38 is a repeat of Example 37. Here, the weight percent FePC2SNa was increased to 0.83 and 0.91, which represents a dosage of 0.63 and 0.69 moles of FePC2SNa per mole of EthSH for examples 37 and 38 respectively. The increase in SSA dosage resulted in a 70 percent removal of EthSH from the feed gas, a 40 percent removal increase over Example 36. In this set of examples the EthSH removal was increased by raising the SSA Dosage through increases in weight percent SSA in the solvent.

Examples 36, 39 and 40

These examples show the effect of changing the liquid to gas ratios (L/G). A total of 0.25 weight percent FePC2SNa was added to aqueous MDEA solvent for all three examples. The liquid to gas ratio was increased from 2.5 in Example 36, to 11.5 in Example 49, and to 46 in Example 40. This increased the SSA Dosage from 0.19 molesSSA/moleEthSH in Example 36, to 0.86 in Example 39, and to 3.5 in Example 40. The SSA Dosage increases resulted in a removal increase of EthSH from 50 percent in Example 36, to 88 percent in Example 39 and to 94 percent in Example 40. It can be seen that what is really important is the SSA Dosage or the moles of SSA introduced into the absorption (or extraction) zone per mole of EthSH introduced. There are three ways to increase the SSA Dosage: (1) increase the weight percent of SSA in the solvent at a fixed L/G Ratio, (2) increase the L/G Ratio at a fixed SSA weight percent in the solvent, and (3) increase both. Sulfur compounds in the (−2) oxidation state can be removed by SSAs in a stand alone process where the use of L/G ratios or SSA weight percent in the solvent is an optimization process. However, in an existing process where the L/G ratio may already be fixed by the process needs, it is the weight percent SSA in the solvent that it is increased to attain the SSA Dosage necessary for the required level of sulfur compound removal.

Examples 41 and 42

These two examples show the difference in performance between Fe and Cu cations in removing EthSH. The solvent used is aqueous UCARSOL CR302. In Example 41 the SSA molecule is CuPC2SNa, and in Example 42 the SSA molecule is FePC2SNa. SSA dosage, L/G Ratio and all other process conditions are the same. With CuPC2SNa, the EthSH removal was 67 percent, and with FePC2SNa the removal was 99 percent. Therefore, under these conditions and in the present solvent medium, the Fe cation is more effective in removing sulfur compounds in the (−2) oxidation state than the Cu cation.

Examples 41, 43 and 44

These examples show the different EthSH removal for di-, tri- and tetra- substituted Cu SSAs. In terms of weight percent SSA in the aqueous solvent, the tri-substituted CuPC3SNa SSA removed 75 percent of the EthSH present, while the di-substituted CuPC2SNa and tetra-substituted CuPC4SNa both removed 67 percent of the sulfur compound. Thus, the tri-substituted molecule works better for this SSA and solvent medium. The SSA Dosage is somewhat different for each of the runs because the molecular weight of the SSA changes with the degree of substitution, all other process variables are nearly the same.

Examples 45a to 45d

These are results obtained from the same experiment as the temperature of the aqueous UCARSOL CR302 solvent going into the absorber (Solvent Temperature (° C.)) was raised from 44° C. in Example 45a, to 48° C. in Example 45b, to 54° C. in Example 45c and finally to 58° C. in Example 45d. As the temperature of the solvent is raised and, consequently, that of the CuPC2Na molecule, the EthSH removal decreases from 67 percent in Example 45a to 33 percent in Example 45d. All other process variables were kept the same. The percent removal at the higher temperatures could have been improved to a higher level of removal by increasing the SSA Dosage to some higher number above 14.4 molesSSA per mole EthSH. Of course, the lower the temperature of the SSA containing solvent, the better the EthSH removal Examples 46 and 47

In Example 46, the SSA CuPC2SNa was thermally regenerated 155 times in the stripper column. That is, the total volume of the aqueous UCARSOL CR302 solvent with 0.64 weight percent of CuPC2SNa passed through the absorber and stripper column and was regenerated 155 times with no loss of performance. In Example 47, the SSA FePC2SNa was thermally regenerated 175 times as the total volume of aqueous UCARSOL CR302 solvent with 0.64 weight percent of FePC2SNa passed through the absorber and stripper column and was regenerated 175 times with no loss of performance. It should be noted that in Example 46 the CuPC2SNa removed 96 percent of the EthSH present while the FePC2SNa in Example 47 removed only 65 percent of the EthSH. However, the number of trays in the absorber was 20 for the CuPC2SNa and only 5 trays in the FePC2SNa example. Thus, the design of the equipment, in this particular case the number of trays in the absorber, also plays an important role in EthSH removal.

Examples 48 to 52

These examples show the simultaneous removal of two compounds, $H_2S$ and EthSH, both with sulfur in the (−2) oxidation state. The aqueous MDEA solvent can remove $H_2S$ in a Bronsted acid-base reaction forming a thermally regenerable salt without the help of the SSA molecule. Aqueous MDEA, however, is not efficient in removing the organic sulfur compound EthSH, and SSA is added to the aqueous amine to improve the removal of EthSH. For all these examples the L/G ratios and SSA Dosage are kept nearly constant.

Example 48, with 4.2 volume percent $H_2S$ in the nitrogen feed gas and no EthSH, shows a 99.8 percent removal of $H_2S$ with pure aqueous MDEA, with no FePC2SNa added to the aqueous amine solvent. In Example 49 the nitrogen feed gas contains the same 4.2 volume percent $H_2S$ plus 1000 ppmv of EthSH. Here, again, the feed gas is treated with aqueous amine alone, no SSA added. In this example the $H_2S$ removal is 99.7 percent and that of EthSH is only 20 volume percent.

In Example 50, a total of 0.74 weight percent FePC2SNa was added to the aqueous MDEA. This resulted in improved removal of both $H_2S$, from 99.7 to 99.9 percent removal, and EthSH, from 20 to 80 percent removal, when compared with Example 49 above with no SSA added. In Example 50, SSA was added to the aqueous MDEA solvent to effect the removal of EthSH, while at the same time improving the removal of the $H_2S$ acid gas.

In Example 51, the amount of $H_2S$ in the nitrogen feed gas was increased to 20 volume percent while the EthSH concentration of 1000 ppmv remained the same. The removal of $H_2S$ and EthSH remained at 99.9 percent and 80 percent respectively.

In Example 52 the $H_2S$ in the nitrogen feed gas was increased to 35 volume percent while the EthSH concentration of 1000 ppmv remained the same. Here, the removal of $H_2S$ remained the same at 99.9 percent removal but that of EthSH dropped to 40 percent. In this case, the overwhelming amount of $H_2S$ present started to displace some of the EthSH from the SSA molecule. The SSA Dosage which had been constant from examples 50 and 51 must now be raised to bring the EthSH recovery up to the desired level by either increasing the L/G Ratio, increasing the weight percent FePC2SNa in the aqueous MDEA or both.

From the data reported in Table 3, it is readily apparent that the SSA used in these examples, when present in a range of between about 0.05 and 1.0 wt %, was effective in removing EthSH (in some of the examples reported in Table 1 the SSA concentration was as high as 10.5 weight percent).

Table 3 also shows that water alone is a good solvent for SSAs, and very effective removal is obtained with SSA Dosages from 1.3 to 13 molesSSA per mole of EthSH. However, SSAs are also very effective in aqueous amine systems used for $H_2S$ removal. Also, sulfur compounds with sulfur in the (−2) oxidation state are often present with $CO_2$ where the sulfur compound needs to be removed selectively, that is, without absorbing $CO_2$. In this case the SSA can be added to the amine system to effect the sulfur removal while slipping $CO_2$. The data show the SSA working in amine mixtures where the acid gas $H_2S$ is removed simultaneously with the EthSH. In other words, the SSA is also improving the removal of the acid gas $H_2S$ which also has its sulfur in the (−2) oxidation state.

As discussed earlier, the temperature of the absorbent is important in that it must be maintained at a temperature at which complexation would be sufficiently strong to prevent decoupling during the absorption process. In the examples, the Cu containing phthalocyanine sodium sulfonate salt is shown to suffer a gradual decrease in absorption capability as the absorbent is supplied to the absorber at temperatures from 44° C. to 58° C. The lower the absorption temperature the higher the removal of EthSH.

As the data in the examples show, the L/G ratio has a significant impact on the ability to remove sulfur compounds from the hydrocarbon stream. As the L/G ratio is increased (i.e., the Gas Flow Rate decreased, or the Liquid Flow Rate increased), the SSA Dosage is also increased. Thus, the degree of removal of sulfur compound at constant absorbent concentration increased. Consequently, a balance between the flow rate of the feed gas, the flow rate of the absorbent, and the concentration of the absorbent, as well as the design of the equipment is necessary to optimize the process. One important parameter that combines the effect of SSA concentration in the solvent and the L/G ratio is the SSA Dosage, or molesSSA introduced into the absorber per moles of EthSH. Table 3 shows that the SSA Dosage can be as low as 0.068 and as high as 14.6 moles of SSA per mole of EthSH.

At concentrations of about 0.25 wt % of FePC2SNA and an L/G ratio from 2.5 to 46, the SSA Dosage increased from 0.19 moles FePC2SNA per mole EthSH to 3.5 moles FePC2SNA per mole EthSH. Thus, sufficient absorbent is present to enable the process to be carried out with varying degrees of sulfur compound removal. The practical advantage is readily apparent: by varying the SSA Dosage, the absorbents of the present invention are effective in commercial applications in which the hydrocarbon gas (or liquid) stream varies in sulfur compound impurity concentration and/or different hydrocarbon streams, each having a different sulfur compound concentration, are commingled. The SSA Dosage required to remove the sulfur compounds can be increased by either increasing the L/G ratio or, if the L/G ratio is fixed by other process requirements or the size of the process or the equipment, the SSA Dosage can be raised by increasing the SSA concentration in the solvent. In cases where it is desirable to reduce L/G ratio in order to increase production (throughput), the SSA concentration can be increased to maintain the same SSA Dosage at the lower L/G Ratio.

EXAMPLES 53–57

Table 4 reports the results of LLE (liquid-liquid equilibrium) experiments conducted using an SSA molecule to remove the prototype organic sulfur molecule EthSH with sulfur in the (−2) oxidation state from the prototype gasoline hydrocarbon n-hexane. In these experiments a known amount of n-hexane is placed inside a pre-wieghted bottle closed with a septum cap and then the desired amount of EthSH is added through the septum with a syringe. The extraction is performed by placing 2.5 grams of the standard n-hexane solution prepared above, and 5.0 grams of the extracting medium, the SSA containing solvent, in a 12 ml vial sealed with a septum cap. After equilibrating the liquid phases, the EthSH concentration in the hexane phase is measured by Gas Chromatography using a sulfur-specific detector.

The first column of the table describes the particular data reported for each example which is set out in a separate column extending from left to right across the table. Definitions of the types of data being reported are as follows:

Example No: Identifies each example performed with a specific number.

Extracting SSA Molecule. Describes the structure of the SSA molecule added to the solvent for the purposes of conducting the example in the same shorthand form described in the tables above.

Solvent (5.0 grams). Describes the solvent that contains the SSA in solution and the amount of solvent phase used in the experiment.

Temperature ° C. The experimental temperature in degree Celsius.

Initial EthSH Concentration in 2.5 grams of n-hexane, ppmw. Indicates the s initial EthSH concentration in weight parts per million in 2.5 grams of the n-hexane hydrocarbon phase used in the experiment.

EthSH Conc in N-hexane After Washing, ppmw. Indicates the concentration of EthSH in weight parts per million in the n-hexane hydrocarbon phase after being washed with the solvent phase.

Percent Removal. The EthSH removed as a percentage of the initial EthSH concentration.

SSA Dosage (molesSSA/molesEthSH). These are the moles of SSA in the SSA containing solvent per moles of EthSH in n-hexane hydrocarbon.

Examples 53 to 57

In Example 53 the EthSH removal is being conducted at 50° C. temperature with pure aqueous MDEA, no SSA added. The EthSH removal is 6.6 percent. After adding 2 weight percent CuPC3SNa to the aqueous amine in Example 54 at 50° C. and with an SSA Dosage of 0.73 molesSSA per mole of EthSH, the EthSH removal was increased to 46.3 percent. In Example 55 at 50° C., water alone removed 6.1 percent of the EthSH present in the hydrocarbon phase. Adding 4.75 weight percent FePC2SNa to the water in Example 56 and at the same temperature, the EthSH removal from the hydrocarbon phase was higher than 95 percent. The SSA Dosage in this example was 7.6 molesSSA per moleEthSH in the hydrocarbon phase. Example 57 is a repeat of Example 56 but at 20° C. Exactly the same results were obtained at the lower temperature. In this case both phases, the EthSH containing phase and the extracting medium, are liquids.

These examples demonstrate the effectiveness of SSAs in removing organic compounds with sulfur in the (−2) oxidation state from liquid hydrocarbon streams. In these examples, n-hexane was used as a prototype compound for gasoline. A removal of 46.3% was obtained at an SSA Dosage of 0.73 for the aqueous MDEA case, and total removal was obtained with water at an SSA Dosage of 7.6.

Examples 53–57 also show the effectiveness of SSAs in removing sulfur compounds including sulfur in the (−2) oxidation state from a liquid hydrocarbon which can be liquid hydrocarbon fractions such as LPG, straight run gasoline, FCC gasoline, diesel fuel, kerosene, and other liquid hydrocarbon feed streams.

TABLE 1

MeSH Molar Loading With Different SSAs and Solvents at 50 C., 1 atm

| Example No. | 1 | 2 | 3 | 4 | 5 | 6 | 7 |
|---|---|---|---|---|---|---|---|
| SSA Molecule | NiPC4SNa | NiPC4SNa | SnPC4SNa | FePC4SNa | Fe Porphine | NiPC4SNa | NiPC2S |
| Wt % SSA in Solvent | 10.1 | 10.5 | 10.1 | 10.0 | 4.48 | 10.2 | 10.1 |
| Solvent (100 g) | SELEXOL | SELEXOL (+4.6 g water) | SELEXOL | SELEXOL | SELEXOL | 50% MDEA | 50% MDEA |
| Loading moles MeSH / moleSSA | not active | 2.1 | 1.9 | 5.2 | 9.5 | not active | 0.23 |
| Regeration Cycles | | none | 2 | 3 | 6 | | none |

| Example No. | 8 | 9 | 10 | 11 | 12 | 13 | 14 |
|---|---|---|---|---|---|---|---|
| SSA Molecule | ZnPC4SNa | ZnPC2SNa | PbPC2S | PbPC2SNa | FePC2S | FePC2S | FePC2SNa |
| Wt % SSA in Solvent | 9.08 | 6.16 | 5.1 | 6.05 | 8.3 | 9.93 | 6.01 |
| Aqueous Solvent (100 g) | 50% MDEA | 50% MDEA | 50% MDEA | 50% MDEA | 50% NMEA | 50% MDEA | 50% CR302 |
| Loading moles MeSH / moleSSA | not active | 0.64 to 0.11 | 2 | 2.1 | not active | 1.0 | 1.2 |
| Regeration Cycles | | 4 | 3 | degraded | | 2 | 4 |

| Example No. | 15 | 16 | 17 |
|---|---|---|---|
| SSA Molecule | CuPC3SNa | CuPC2S4Cl | CuPC3SNa |
| Wt % SSA in Solvent | 5.0 | 5.0 | 6.09 |
| Aqueous Solvent (100 g) | 50% MDEA | 50% MDEA | 50% DEA |
| Loading moles MeSH / moleSSA | 0.9 | 1.0 | 1.8 |
| Regeration Cycles | 5 | 5 | 3 |

In SELEXOL, SSA was in a dispersion.

TABLE 2

VLE Experiments With a Commercial Natural Gas.
Solvent: UCARSOL CR302

| | Example No. | | | | | | |
|---|---|---|---|---|---|---|---|
| | 18 | 19 | 20 | 21 | 22 | 23 | 24 |
| Sweet Natural Gas Description | Untreated | Treated | Treated | Treated | Treated | Treated | Treated |
| SSA Molecule Type | | none | CuPC4SNa | CuPC4SNa | CuPC4SNa | CuPC4SNa | FePC4SNa |
| Wt % SSA in Aqueous Solvent | | 0 | 0.2 | 1 | 1 | 5 | 0.2 |
| Times SSA was Regenerated | | | 0 | 0 | 1 | 0 | 0 |
| Natural Gas Impurities | ppmv / Percent Removal | | | | | | |
| Carbonyl Sulfide | 44 | 32 / 27% | 1 / 98% | 1 / 98% | 3 / 93% | 6 / 86% | 3 / 93% |
| Methyl Mercaptan | 174 | 87 / 50% | 31 / 82% | 6 / 97% | 2 / 99% | 101 / 42% | 0 / 100% |
| Ethyl Mercaptan | 87 | 45 / 48% | 19 / 78% | 3 / 97% | 1 / 99% | 48 / 45% | 0 / 100% |
| Propyl Mercaptan | 31 | 20/ 35% | 13 / 58% | 3 / 97% | 1 / 97% | 21 / 32% | 0 / 100% |
| C4+ Mercaptans | 10 | 2 / 80% | 15 / — | 13 / — | 29 / — | 5 / 50% | 9 / 10% |
| Dimethyl Sulfide | 4 | 3 / 25% | 2 / 50% | 2 / 50% | 1 / 75% | 2 / 50% | 2 / 50% |
| Dimethyl Disulfide | 5 | 8 / — | 34 / — | 23 / — | 26 / — | 9 / — | 35 / — |
| Diethyl Disulfide | 6 | 4 / 33% | 29 / — | 20 / — | 30 / — | 6 /— | 23 / — |
| TOTAL | 360 | 201 / 44% | 144 / 60% | 71 / 80% | 93 / 74% | 198 / 45% | 72 / 80% |

| | Example No. | | | | |
|---|---|---|---|---|---|
| | 25 | 26 | 27 | 28 | 29 |
| Sweet Natural Gas Description | Treated | Treated | Treated | Treated | Treated |
| SSA Molecule Type | FePC4SNa | FePC4SNa | PbPC4SNa | PbPC4SNa | PbPC4SNa |
| Wt % SSA in Aqueous Solvent | 1 | 5 | 0.2 | 1 | 5 |
| Times SSA was Regenerated | 0 | 0 | 0 | 0 | 0 |
| Natural Gas Impurities | ppmv / Percent Removal | | | | |
| Carbonyl Sulfide | 3 / 93 | 1 / 98% | 0 / 100% | 3 / 93% | 0 / 100% |
| Methyl Mercaptan | 1 / 99% | 0 / 100% | 1 / 99% | 10 / 94% | 2 / 99% |
| Ethyl Mercaptan | 1 / 99% | 0 / 100% | 0 / 100% | 5 / 94% | 3 / 97% |
| Propyl Mercaptan | 3 / 90% | 0 / 100% | 0 / 100% | 5 / 84% | 6 / 81% |

TABLE 2-continued

| VLE Experiments With a Commercial Natural Gas. Solvent: UCARSOL CR302 | | | | | |
|---|---|---|---|---|---|
| C4+ Mercaptans | 33 / — | 30 / — | 20 / — | 25 / — | 9 / 10% |
| Dimethyl Sulfide | 3 / 25% | 1 / 75% | 2 / 50% | 3 / 25% | 2 / 50% |
| Dimethyl Disulfide | 30 / — | 27 / — | 38 / — | 38 / — | 11 / — |
| Diethyl Disulfide | 38 / — | 28 / — | 29 / — | 36 / — | 12 / — |
| TOTAL | 112 / 69% | 87 / 76% | 90 / 75% | 125 / 65% | 45 / 88% |

TABLE 3

(Upgraded equipment)
Ethyl Mercaptan Removal at Different SSA Concentration - Solvent: Water

| | Example No. | | | |
|---|---|---|---|---|
| | 30 | 31 | 32 | 33 |
| SSA Molecule Type | none | FePC2SNa | FePC2SNa | FePC2SNa |
| Wt % SSA in Solvent | 0 | 0.1 | 1.0 | 1.0 |
| Wt % Amine in Water | 0 | 0 | 0 | 0 |
| Solvent Rate (CC/Min) | 46 | 46 | 46 | 46 |
| N2 Feed Gas Rate (SL/Min) | 1.0 | 1.0 | 1.0 | 1.0 |
| L/G Ratio (CC/SL) | 46 | 46 | 46 | 46 |
| Absober Pressure (psia) | 15.7 | 15.7 | 15.7 | 15.7 |
| Solvent Temperature (C.) | 39.6 | 39.3 | 37.2 | 39.6 |
| Absorber No of Trays | 20 | 20 | 20 | 20 |
| Stripper Top Temp. (C.) | 100 | 100 | 100 | 101 |
| Stripper Reboiler Temp. (C.) | 102.7 | 102.1 | 102.5 | 102.4 |
| Stripper No of Trays | 20 | 20 | 20 | 20 |
| EthSH in Feed Gas (ppmv) | 1100 | 1000 | 1000 | 1000 |
| EthSH in Treated Gas (ppmv) | 700 | 400 | <1 | 1 |
| EthSH Percent Removal | 36% | 60% | 100% | 100% |
| SSA Dosage (molesSSA/molesEthSH) | none | 1.3 | 13 | 13 |
| SSA Loading (molesEthSH/moleSSA) | | 0.23 | 0.053 | 0.052 |

(Upgraded equipment)
Ethyl Mercaptan Removal at Different SSA Concentration - Solvent: Aqueous MDEA

| | Example No. | | | | |
|---|---|---|---|---|---|
| | 34 | 35 | 36 | 37 | 38 |
| SSA Molecule Type | none | FePC2SNa | FePC2SNa | FePC2SNa | FePC2SNa |
| Wt % SSA in Solvent | 0 | 0.09 | 0.25 | 0.83 | 0.91 |
| Wt % Amine in Water | 44 | 42.9 | 49.2 | 41.5 | 45.3 |
| Solvent Rate (CC/Min) | 10 | 10 | 10 | 10 | 10 |
| N2 Feed Gas Rate (SL/Min) | 4.0 | 4.0 | 4.0 | 4.0 | 4.0 |
| L/G Ratio (CC/SL) | 2.5 | 2.5 | 2.5 | 2.5 | 2.5 |
| Absober Pressure (psia) | 15.7 | 15.7 | 15.7 | 15.7 | 15.7 |
| Solvent Temperature (C.) | 29.1 | 29.0 | 30.7 | 29.2 | 28.8 |
| Absorber No of Trays | 20 | 20 | 20 | 20 | 20 |
| Stripper Top Temp. (C.) | 103 | 101 | 103 | 102 | 101 |
| Stripper Reboiler Temp. (C.) | 105.3 | 105.4 | 105.9 | 105.1 | 105.1 |
| Stripper No of Trays | 20 | 20 | 20 | 20 | 20 |
| EthSH in Feed Gas (ppmv) | 1000 | 1000 | 1000 | 1000 | 1000 |
| EthSH in Treated Gas (ppmv) | 600 | 550 | 500 | 300 | 300 |
| EthSH Percent Removal | 40% | 45% | 50% | 70% | 70% |
| SSA Dosage (molesSSA/molesEthSH) | none | 0.068 | 0.19 | 0.63 | 0.69 |
| SSA Loading (molesEthSH/moleSSA) | | 0.74 | 0.54 | 0.48 | 0.44 |

(Upgraded equipment)
Ethyl Mercaptan Removal at Different Liquid to Gas (L/G) Ratios - Solvent: Aqueous MDEA

| | Example No. | | |
|---|---|---|---|
| | 36 | 39 | 40 |
| SSA Molecule Type | FePC2SNa | FePC2SNa | FePC2SNa |
| Wt % SSA in Solvent | 0.25 | 0.25 | 0.25 |
| Wt % Amine in Water | 49.2 | 49.4 | 47.7 |
| Solvent Rate (CC/Min) | 10 | 46 | 46 |
| N2 Feed Gas Rate (SL/Min) | 4.0 | 4.0 | 1.0 |

TABLE 3-continued

| | | | |
|---|---|---|---|
| L/G Ratio (CC/SL) | 2.5 | 11.5 | 46 |
| Absober Pressure (psia) | 15.7 | 15.7 | 15.7 |
| Solvent Temperature (C.) | 30.7 | 39.7 | 40.6 |
| Absorber No of Trays | 20 | 20 | 20 |
| Stripper Top Temp. (C.) | 103 | 103 | 102 |
| Stripper Reboiler Temp. (C.) | 105.9 | 106.2 | 105.6 |
| Stripper No of Trays | 20 | 20 | 20 |
| EthSH in Feed Gas (ppmv) | 1000 | 1000 | 1000 |
| EthSH in Treated Gas (ppmv) | 500 | 120 | 60 |
| EthSH Percent Removal | 50% | 88% | 94% |
| SSA Dosage (molesSSA/molesEthSH) | 0.19 | 0.86 | 3.5 |
| SSA Loading (molesEthSH/moleSSA) | 0.54 | 0.56 | 0.16 |

Comparison of Fe vs Cu Cations - Solvent: Aqueous CR302

| | Example No. | |
|---|---|---|
| | 41 | 42 |
| SSA Molecule Type | CuPC2SNa | FePC2SNa |
| Wt % SSA in Solvent | 0.6 | 0.6 |
| Wt % Amine in Water | 32 apx | 32 apx |
| Solvent Rate (CC/Min) | 46 | 46 |
| N2 Feed Gas Rate (SL/Min) | 1.0 | 1.0 |
| L/G Ratio (CC/SL) | 46 | 46 |
| Absober Pressure (psia) | 15 | 15 |
| Solvent Temperature (C.) | 40 | 38 |
| Absorber No of Trays | 20 | 20 |
| Stripper Top Temp. (C.) | 97 | 100 |
| Stripper Reboiler Temp. (C.) | 105.2 | 104.0 |
| Stripper No of Trays | 20 | 20 |
| EthSH in Feed Gas (ppmv) | 600 | 600 |
| EthSH in Treated Gas (ppmv) | 200 | 5 |
| EthSH Percent Removal | 67% | 99% |
| SSA Dosage (molesSSA/molesEthSH) | 14.4 | 14.6 |

Degree of Sodium Sulfonate Substitution - Solvent: Aqueous CR302

| | Example No. | | |
|---|---|---|---|
| | 41 | 43 | 44 |
| SSA Molecule Type | CuPC2SNa | CuPC3SNa | CuPC4SNa |
| Wt % SSA in Solvent | 0.64 | 0.61 | 0.64 |
| Wt % Amine in Water | 32 apx | 32 apx | 32 apx |
| Solvent Rate (CC/Min) | 46 | 46 | 46 |
| N2 Feed Gas Rate (SL/Min) | 1.0 | 1.0 | 1.0 |
| L/G Ratio (CC/SL) | 46 | 46 | 46 |
| Absober Pressure (psia) | 15 | 15 | 15 |
| Solvent Temperature (C.) | 40 | 38 | 40 |
| Absorber No of Trays | 20 | 20 | 20 |
| Stripper Top Temp. (C.) | 97 | 93 | 91 |
| Stripper Reboiler Temp. (C.) | 105.2 | 105.0 | 104.8 |
| Stripper No of Trays | 20 | 20 | 20 |
| EthSH in Feed Gas (ppmv) | 600 | 600 | 600 |
| EthSH in Treated Gas (ppmv) | 200 | 50 | 200 |
| EthSH Percent Removal | 67% | 75% | 67% |
| SSA Dosage (molesSSA/molesEthSH) | 14.40 | 12.10 | 11.40 |

Solvent Temperature on EtSH Removal - Solvent: Aqueous CR302

| | Example No. | | | |
|---|---|---|---|---|
| | 45a | 45b | 45e | 45d |
| SSA Molecule Type | CuPC2SNa | CuPC2SNa | CuPC2SNa | CuPC2SNa |
| Wt % SSA in Solvent | 0.64 | 0.64 | 0.64 | 0.64 |
| Wt % Amine in Water | 32 apx | 32 apx | 32 apx | 32 apx |
| Solvent Rate (CC/Min) | 46 | 46 | 46 | 46 |
| N2 Feed Gas Rate (SL/Min) | 1.0 | 1.0 | 1.0 | 1.0 |
| L/G Ratio (CC/SL) | 46 | 46 | 46 | 46 |
| Absober Pressure (psia) | 15 | 15 | 15 | 15 |
| Solvent Temperature (C.) | 44 | 48 | 54 | 58 |
| Absorber No of Trays | 20 | 20 | 20 | 20 |
| Stripper Top Temp. (C.) | 101 | 102 | 100 | 100 |
| Stripper Reboiler Temp. (C.) | 104.1 | 104.0 | 104.6 | 104.3 |
| Stripper No of Trays | 20 | 20 | 20 | 20 |
| EthSH in Feed Gas (ppmv) | 600 | 600 | 600 | 600 |
| EthSH in Treated Gas (ppmv) | 200 | 300 | 350 | 400 |

TABLE 3-continued

| | | | | |
|---|---|---|---|---|
| EthSH Percent Removal | 67% | 50% | 42% | 33% |
| SSA Dosage (molesSSA/molesEthSH) | 14.4 | 14.4 | 14.4 | 14.4 |

SSA Molecule Regenerability And Absorber Trays - Solvent: CR302

| | Example No. | |
|---|---|---|
| | 46 | 47 |
| SSA Molecule Type | CuPC2SNa | FePC2SNa |
| Wt % SSA in Solvent | 0.64 | 0.64 |
| Wt % Amine in Water | 32 apx | 32 apx |
| Solvent Rate (CC/Min) | 46 | 46 |
| N2 Feed Gas Rate (SL/Min) | 1.0 | 1.0 |
| L/G Ratio (CC/SL) | 46 | 46 |
| Absober Pressure (psia) | 15 | 15 |
| Solvent Temperature (C.) | 35 | 35 |
| Absorber No of Trays | 20 | 5 |
| Stripper Top Temp. (C.) | 90 | 100 |
| Stripper Reboiler Temp. (C.) | 103.8 | 104.5 |
| Stripper No of Trays | 20 | 20 |
| EthSH in Feed Gas (ppmv) | 1000 | 800 |
| EthSH in Treated Gas (ppmv) | 40 | 300 |
| EthSH Percent Removal | 96% | 63% |
| SSA Regeneration Cycles | 155 | 175 |
| SSA Dosage (molesSSA/molesEthSH) | 8.7 | 10.8 |

EtSH Removal In The Presence Of H2S - Solvent: MDEA

| | Example No. | | | | |
|---|---|---|---|---|---|
| | 48 | 49 | 50 | 51 | 52 |
| SSA Molecule Type | none | none | FePC2SNa | FePC2SNa | FePC2SNa |
| Wt % SSA in Solvent | 0 | 0 | 0.74 | 0.70 | 0.76 |
| Wt % Amine in Water | 42 | 38 apx | 37 | 35 | 38 apx |
| Solvent Rate (CC/Min) | 50 | 50 | 50 | 50 | 50 |
| N2 Feed Gas Rate (SL/Min) | 1.0 | 1.0 | 1.0 | 1.0 | 1.0 |
| L/G Ratio (CC/SL) | 50 | 50 | 50 | 50 | 50 |
| Absober Pressure (psia) | 15 | 15 | 15 | 15 | 15 |
| Solvent Temperature (C.) | 42 | 48 | 46 | 43 | 44 |
| Absorber No of Trays | 20 | 20 | 20 | 20 | 20 |
| Stripper Top Temp. (C.) | 103 | 104 | 105 | 103 | 93 |
| Stripper Reboiler Temp. (C.) | 108.0 | 107.4 | 107.3 | 107.3 | 107.5 |
| Stripper No of Trays | 20 | 20 | 20 | 20 | 20 |
| Vol % H2S/ppmv EthSH in Feed Gas | 4.2/0 | 4.2/1000 | 4.5/1000 | 20/1000 | 35/1000 |
| Vol % H2S/ppmv EthSH in Treated Gas | 0.008/0 | 0.012/800 | 0.004/200 | 0.006/200 | 0.020/600 |
| Percent Removal H2S/EthSH | 99.8/— | 99.7/20 | 99.9/80 | 99.9/80 | 99.9/40 |
| SSA Dosage (molesSSA/molesEthSH) | none | none | 11.0 | 10.4 | 11.3 |
| SSA Loading (molesEthSH/moleSSA) | | | 0.054 | 0.058 | 0.035 |

TABLE 4

Liquid–Liquid Extraction of EthSH from Gasoline (N-Hexane) With SSA

| Example No. | 53 | 54 | 55 | 56 | 57 |
|---|---|---|---|---|---|
| Extracting SSA Molecule | none | CuPC3SNa 2 wt % | none | FePC2SNa 4.75 wt % | FePC2SNa 4.75 wt % |
| Solvent (5.0 grams) | 50 wt % Aqueous MDEA | 50 wt % Aqueous MDEA | Water | Water | Water |
| Temperature C. | 50 | 50 | 50 | 50 | 20 |
| Initial EthSH Concentration in 2.5 grams of N-hexane, ppm | 3818 | 3818 | 1004 | 1004 | 1004 |
| EthSH Conc in N-hexane After Washing, ppm | 3565 | 2049 | 943 | <50 | <50 |
| Percent Removal | 6.60% | 46.30% | 6.10% | >95.0% | >95.0% |
| SSA Dosage (molesSSA/molesEthSH) | 0.73 | 0.73 | none | 7.6 | 7.6 |

We claim:

1. A process for removing sulfur compounds including sulfur in a (−2) oxidation state from a feed streams, said process comprising the steps of:

(a) contacting a feed stream containing at least one sulfur compound including sulfur in a (−2) oxidation state with a regenerable sulfur selective absorbent comprising a metal cation in a given oxidation state complexed with an organic ligand;

(b) forming with the absorbent and the sulfur compound a plurality of sulfur-metal cation coordination complexes in which the oxidation state of the sulfur compound and the metal ion remains essentially unchanged;

(c) separating the sulfur-metal cation coordination complexes from the feed stream; and (d) thermally regenerating the absorbent by disassociating the sulfur compound from at least some of the plurality of complexes.

2. The process of claim 1 further including the step of:

recovering at least a portion of the regenerated absorbent for use in removing additional sulfur compounds from the feed stream.

3. The process of claim 1, wherein the absorbent is regenerated by at least one of heating and stripping.

4. The process of claim 3, wherein the step of forming the plurality of sulfur-metal cation coordination complexes is further characterized in that the metal cation binds to the sulfur in the (−2) oxidation state with a binding strength sufficiently high to form a stable complex and sufficiently low to enable the sulfur and the metal ion to disassociate upon heating and/or stripping.

5. The process of claim 1 further including the step of dissolving or suspending the absorbent in a liquid prior to step (a).

6. The process of claim 5, wherein the liquid is selected from the group consisting of water, aqueous solution and an organic solvent.

7. The process of claim 6, wherein the aqueous solution comprises an aqueous amine solution.

8. The process of claim 6, wherein the organic solvent comprises a mixture of dialkyl ethers of polyalkylene glycols.

9. The process of claim 5, wherein the organic ligand includes at least one substituent to further improve the solubility of the absorbent in an aqueous solution or organic solvent and modify the sulfur complexing activity of the absorbent.

10. The process of claim 1, wherein the metal cation is selected from the group consisting of Fe, Ru, Os, Co, Rh, Ir, Ni, Pd, Pt, Cu, Ag, Au, Zn, Cd, Hg, Al, Ga, In, Tl, Ge, Sn, Pb, Sb, and Bi.

11. The process of claim 1, wherein the organic ligand is one of a phthalocyanine and a porphyrin composition.

12. The process of claim 9, wherein the at least one substituent is selected from the group consisting of: alkyl, hydroxyalkyl, quaternary ammonium, polyether, phenol, alkyl phenol, ethoxylated phenol, amino compounds, carboxylic acids and their salts, and sulfonic acid salts.

13. The process of claim 5, wherein the absorbent is in solution at a concentration of from about 0.05 wt % to about 15 wt % of the solvent.

14. The process of claim 1, wherein a temperature differential of at least about 5° C. is provided between step (b) and step (c).

15. The process of claim 1, wherein steps (a) and (b) are carried out at a pressure of from about atmospheric pressure to about 1500 psig.

16. The process of claim 1, wherein the feed stream is a hydrocarbon feed stream.

17. The process of claim 3, wherein the absorbent is regenerated by at least one of boiling and steam stripping.

* * * * *